US006549749B2

(12) United States Patent
Guerrero

(10) Patent No.: US 6,549,749 B2
(45) Date of Patent: Apr. 15, 2003

(54) PRINTERS EMPLOYING DUPLEX REGISTRATION FOR POST PRINTING OPERATIONS

(75) Inventor: Marco A. Guerrero, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 35 days.

(21) Appl. No.: 09/872,229

(22) Filed: May 31, 2001

(65) Prior Publication Data

US 2002/0181984 A1 Dec. 5, 2002

(51) Int. Cl.[7] ..... G03G 15/00
(52) U.S. Cl. ..... 399/407; 399/402
(58) Field of Search ..... 399/401, 402, 399/407, 408, 409, 410

(56) References Cited

U.S. PATENT DOCUMENTS 5,481,354 A * 1/1996 Nakajima ..... 399/410 X
5,594,542 A * 1/1997 Sugimoto et al. ..... 399/402
5,708,954 A * 1/1998 Ando et al. ..... 399/402
5,926,684 A * 7/1999 Horiuchi et al. ..... 399/402

FOREIGN PATENT DOCUMENTS

JP 05-286281 * 11/1993

* cited by examiner

*Primary Examiner*—Sandra Brase

(57) ABSTRACT

Duplex printers are provided with sheet registration utilization devices that take further advantage of the sheet registration capabilities of such printers. These sheet registration utilization devices include staplers, gluing devices and 2 or 3 hole punch systems.

20 Claims, 7 Drawing Sheets

PRINTERS EMPLOYING DUPLEX REGISTRATION FOR POST PRINTING OPERATIONS

BACKGROUND OF THE INVENTION

1. Field of the Invention

The present invention generally relates to duplex printers. More particularly, it relates to sheet registration apparatus of duplex printers.

2. Prior Art

Duplex printing capabilities are fast becoming standard features in desktop printers. In duplex printing operations, a sheet of print media such as paper is: (1) drawn from a stack of sheets that are in registration, (2) sent to a printing device (electrophotographic printer or inkjet printer)where it receives printing on a first side of the sheet, (3) turned or "flipped" over and (4) sent back to the printing device where it receives printing on its second side. A sheet that has been flipped over will normally be out of registration with other sheets (that have likewise been flipped over) when said sheets are delivered to a common collection station. That is to say that these sheets experience lateral movements and/or skew movements with respect to each other as a result of being flipped over and otherwise handled by those sheet handling devices that are employed in duplex printers.

Consequently, sheets that have received printing on their first sides must be sent to a sheet registration device before they are sent back to the printer to receive printing on their second sides. In effect, the registration device physically eliminates the effects of the lateral and/or skew movements of the individual sheets and/or electronically compensates for the effects of such movements. Thus, high quality desktop duplex printing machines require—and are commonly provided with—some kind of sheet registration device. The hereindescribed invention takes advantage of this circumstance.

SUMMARY OF THE INVENTION

The present invention provides sheet registration utilization devices that take further advantage of the sheet registration capabilities of printers in general and desktop duplex printers in particular. In effect, applicants sheet registration utilization devices perform additional operations on a stack of sheets that have been placed in registration by a registration device whose primary function is to place a stack of sheets in registration so that they can properly receive printing on their respective second sides. Thus, using the hereindescribed sheet registration devices, sheets registered in a duplex printer in order to print on their second sides are thereafter registered once more, so that a registered stack of such sheets can be bound (e.g., by gluing, stapling, etc.), provided with holes (e.g., for 3 hole punch systems, 2 hole punch systems, binder coil holes, etc.) or otherwise prepared for assembly.

The sheet registration utilization devices of this patent disclosure can be used with any automated business machine for producing or reproducing hard copy documents (such as electrophotographic printers, inkjet printers, copiers, facsimile machines, document scanners and the like) provided that such an automated business machine has a sheet registration mechanism. A wide variety of such sheet registration mechanisms are well known to the automated business machine manufacturing arts. Those sheet registration mechanisms that leave an edge side of a registered stack freely accessible to applicant's sheet registration utilization device are, however, particularly preferred for practice of this invention.

Applicant's sheet registration utilization devices are particularly useful in electrophotographic printers having duplex printing capabilities. Consequently, such a printer will be used as an example to further illustrate this invention. Such an electrophotographic printer apparatus could, for example, comprise: (1) a laser device for creating an image on a photoconductor drum, (2) a toner hopper for storing, and then dispensing toner particles on to the photoconductor drum, (3) a first sheet transport system that leads from a sheet dispenser tray to the printer device and then to an internal sheet registration device (such as a sheet collection tray which performs a registration function as part of a duplex printing function), (4) a second sheet transport system that carries a sheet from the internal sheet registration device back to the printer and (5) a sheet registration utilization device that takes further advantage of the sheet registration capability of the printer. For example, a sheet that has received printing on its second side can be sent back to the same registration device where it is again put in registration with a stack of other sheets. The resulting, twice registered, stack of duplex printed material is then subjected to an additional operation (e.g., stapling, gluing, hole punching, etc.) that requires that the sheets in the stack be in registration.

DETAILED DESCRIPTION OF THE INVENTION

Figure 1:
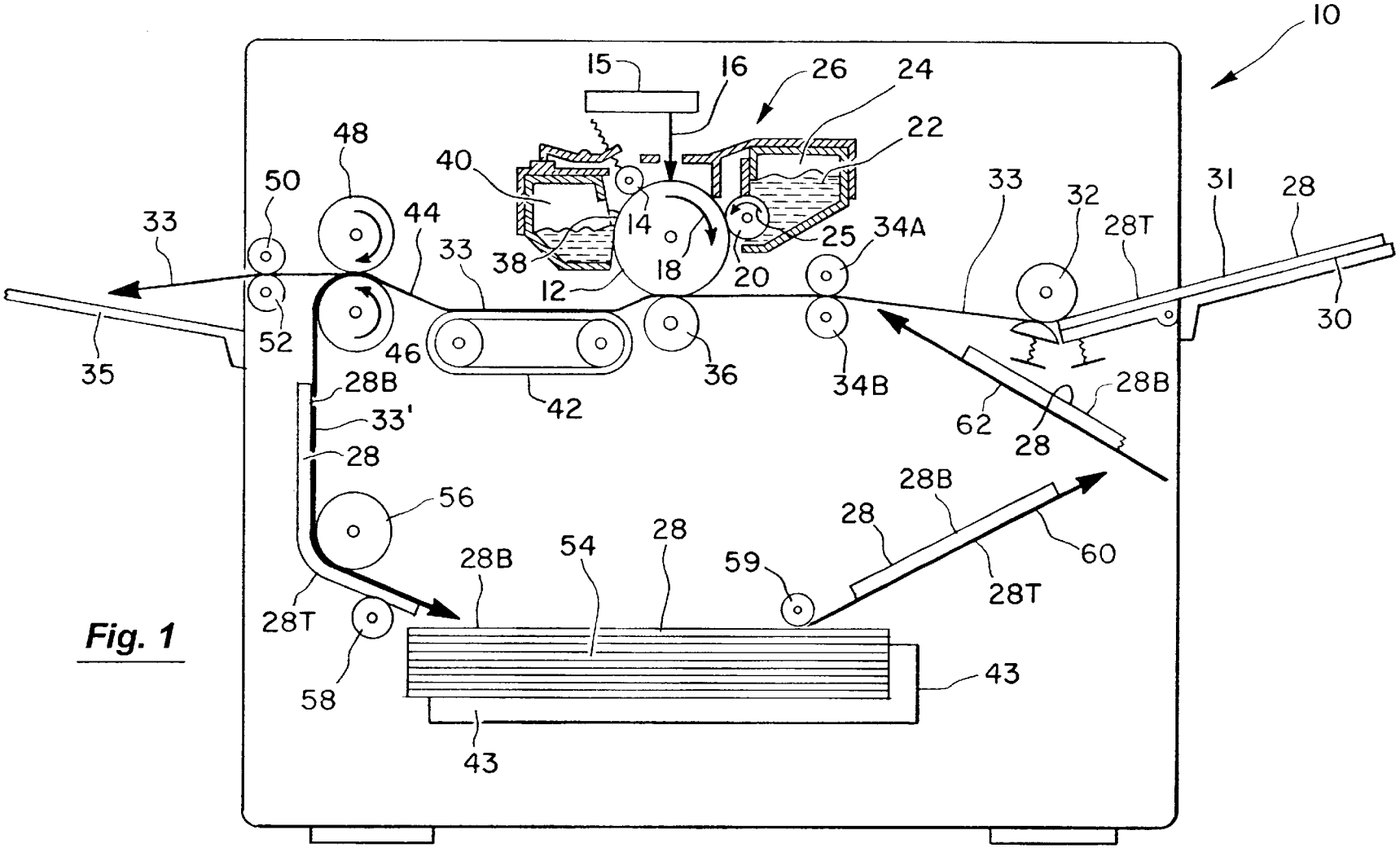
FIG. 1 is a cross sectional view of a highly generalized, prior art electrophotographic printer having a sheet registration device for carrying out a duplex printing operation.

FIG. 1 shows a cross sectional view of a highly generalized prior art electrophotographic printer 10. Again this electrophotographic printer 10 could be replaced by an inkjet printer having a sheet registration device (or another type of printer having a sheet registration device) and the inventive concepts of the present patent disclosure would still be applicable. That is to say that the present invention is concerned with devices that carry certain mechanical operations with respect to a stack of sheets that are in registration—no matter what type of duplex printer device is employed to place them in such registration. In other words, the registration needed by the hereindescribed sheet registration utilization devices is created by the same registration device used to register the sheets so they can properly receive printing on their second sides in a duplex printing operation.

Be the printers and registration devices as they may, the exemplary electrophotographic printer 10 shown in FIG. 1 contains a photoconductor drum 12 upon which a latent electrostatic image is placed, and thereafter removed, by methods well known to the electrophotographic printing arts. For example, a charge roller 14 can be used to charge the surface of the photoconductor drum 12 to a predetermined voltage. A laser scanner 15 emits a laser beam 16 that is pulsed on and off as it is swept across the surface of the photoconductor drum 12 and thereby discharging select portions of said drum surface according to a computer program. The selectively discharged portions of the surface of the drum 12 constitute a latent electrostatic image. The photoconductor drum 12 rotates (e.g., in the clockwise direction suggested by arrow 18) into contact with a developer roller 20.

The developer roller 20 is used to develop the latent electrostatic image in those places where the surface of the photoconductor drum 12 has been selectively discharged by the laser beam 16. Charged toner particles 22 having magnetic properties, stored in a toner hopper 24 of an electrophotographic print cartridge 26, are removed from the toner hopper 24 and transferred to the developer roller 20. For example, a magnet (not shown) located within the developer roller 20 can be used to magnetically attract magnetically active toner particles 22 to the surface of the developer roller 20. As the developer roller 20 rotates (e.g., in the counterclockwise direction 25 shown in FIG. 1), the toner particles 22 on the surface of the developer roller 20 are electrostatically drawn across a gap between the surface of the photoconductor drum 12 and the surface of the developer roller 20 and thereby develop the latent electrostatic image in those areas of the drum 12 that were not discharged by the laser beam 16. This developed electrostatic image is then ready to be transferred to a print medium such as a sheet of paper.

In order to accomplish this printing function, the printer 10 is provided with a sheet feed tray 30 on a sheet entry side of said printer. One by one, a series of top sheets of print media (such as sheets of paper) are removed from a stack 31 of sheets that rest in registration on the sheet feed tray 30. Any given top sheet 28 in the stack 31 can be regarded as a subject sheet for the purposes of this patent disclosure. Such a given top sheet 28 will be used as a working example in tracing various print media paths through this printer 10, as well as through the novel printer 10A shown in FIG. 2. Any such top sheet 28 has a nominal top side 28T and a nominal bottom side 28B. Such top sheets are sequentially removed from the stack 31 by a pick device 32 and sent along a first part of a media path 33 that often includes at least one guide roller system 34A/34B. Such a sheet 28 then passes over a transfer roller 36 and under the photoconductor drum 12. That is to say that a given sheet of print media 28 passes between the transfer roller 36 and the photoconductor drum 12. Thus, the vertical space between the bottom of the drum 12 and the top of the transfer roller 36 may be regarded as a vertical, toner transfer zone 37. This is where the electrophotographic printing function takes place, i.e., the transfer roller 36 electrostatically attracts toner particles 22 away from the surface of the photoconductor drum 12 and onto the top surface 28T of a given sheet of print media 28.

This transfer of toner particles 22 from the surface of photoconductor drum 12 to the top surface 28T of the print media 28 does not, however, occur with one hundred percent efficiency. Therefore, some toner particles will remain on the surface of photoconductor drum 12. Consequently, as photoconductor drum 12 continues to rotate, those untransferred toner particles (i.e., those toner particles that continue to adhere to the surface of the photoconductor drum 12) are removed by a cleaning blade 38 and deposited in a toner waste hopper 40. Having had the untransferred toner particles wiped from its surface, the photoconductor drum 12 is again ready to be charged by charge roller 14 to complete the photoconductor drum's rotation cycle.

Meanwhile, as a given sheet of print media 28 moves further along the further defined media path 33 (i.e., past photoconductor drum 12 and transfer roller 36), a conveyer belt 42 receives and delivers the print-carrying media 28 to an inlet guide or ramp 44 that leads to a to fuser roller/pressure roller device 46/48. Here, a sheet of print media 28 passes between a fuser roller 46 and a pressure roller 48 under conditions of both heat and pressure. These conditions tend to fuse the printed image created in the toner transfer zone 37 to a surface of the sheet of print media. For example, the fuser roller/pressure roller device 46/48 can serve to affix such toner particles to the top surface 12T of the sheet of print media 28. Preferably, the fuser roller 46 provides heat to a rolling interface of said rollers while pressure roller 48 provides a powered, pressured rolling interface relationship between the two rotating roller surfaces. It also provides the motive force needed to pull the print media 28 through the fuser roller 46/pressure roller 48 interface.

Once through the fuser roller/pressure roller device 46/48, such a sheet 28 can follow one of two general paths. The first general path 33 can carry such a sheet 28 outside of the printer 10 via an output roller system 50/52 (comprised of a top roller 50 turning in a clockwise manner and a bottom roller 52 turning in a counterclockwise manner). The output roller system 50/52 deposits said sheet in an output tray 35. The output tray 35 preferably lies entirely outside the housing of the printer 10 for easy manual access to a stack of finished print product. Those skilled in this art will appreciate that the part of the media path 33 leading to the output tray 35 will normally (but not necessarily), be followed by a sheet 28 that has received printing on both its top side 12T and on its bottom side 12B.

The second general path 33' sends a sheet 28 to a sheet registration device located within the printer 10. FIG. 1 therefore illustrates how, in order to complete a duplex printing operation, a sheet 28 having printing on its top side 12T can be sent over a second or alternative media path 33' defined with the printer 10. The mechanical devices used to carry a given sheet 28 over this second or alternative path 33' are complex. Hence, they are only symbolized in FIG. 1 by a powered roller 56 and a guide roller 58. Be that as it may, a sheet 28 traveling over this second path 33' is eventually delivered to a sheet registration device 43. This registration device 43 is illustrated in a highly generalized manner in FIG. 1. The mechanical details of such sheet registration devices vary, but are generally well known to those skilled in the automated business machine manufacturing arts. They too, however, are omitted from FIG. 1 for the sake of visual clarity of certain other concepts (illustrated in FIGS. 2–7) that are more germane to this patent disclosure.

It also should be noted that a sheet 28 that does travel over the second or alternative media path 33' leading to the registration device 43 will be turned or "flipped" over in passing over the powered roller 56 depicted in FIG. 1. Thus the bottom side 12B of sheet 28 becomes its "top side" when said sheet is placed in a registered stack 54 of such sheets.

Thereafter, these registered sheets can be serially removed from the registered stack 54 by a pick roller 59 and sent over a third path that is generally depicted in FIG. 1 by direction arrows 60 and 62. The details of the mechanical devices used to create media paths 60 and 62 are complex, but generally well known to those skilled in the automated business machine sheet handling arts. Hence, they too have been deleted from FIG. 1 for the purposes of visual clarity. Suffice it to say that such sheet handling devices placed along sheet handling paths 60 and 62 are capable of taking a given sheet 28 from the registered stack 54 and delivering it to the same toner transfer zone 37 where it received printing on its top side 12T. That is to say that the sheet 12 is delivered to the toner transfer zone 37 with its bottom side 28B facing upward to receive toner from the photoconductor drum 12 and thereby carry out a duplex printing operation. To this end such a sheet 12 is shown being delivered to a part of the media path 33 that lies before the 34A/34B roller device. In other words, the sheet handling path 62 delivers a sheet 12 to some part of the media path 33 that lies prior to the toner transfer zone 37.

Thus, such an electrophotographic duplex printing device could comprise: (1) a laser printing device for creating a latent image on a photoconductor drum; (2) a photoconductor drum whose outside surface defines an upper side of a toner transfer zone; (3) a transfer roller whose outside surface defines a lower side of the toner transfer zone; (4) a first media path that leads through the printing device while it is in a first mode of operation; (5) a second media path that leads to a sheet registration device; (6) a third media path that leads from the registration device back to the toner transfer zone; (7) a sheet registration device that (i) places a stack of sheets in registration for a first time in order to carry out a duplex printing operation on said sheets and (ii) places a stack of said sheets in registration for a second time so that said sheets in registration for the second time can be subjected to an operation carried out by a sheet registration utilization device used in a second mode of operation of this printer 10A; and (8) a sheet registration utilization device that carries out a mechanical operation on the sheets in registration for the second time.

Those skilled in this art also will appreciate that the apparatus 10 shown in FIG. 1 may include one or more interim sheet collection stations (not shown). This follows from the fact that "incoming" sheets (incoming to the registration device 43) traveling over the second media path 33' can not be delivered to the top of the registered stack 54 while "outgoing" sheets are being removed from that same stack 54. Thus, incoming sheets are preferably held in an interim collection station (not shown) until the registered stack 54 is entirely unloaded from the sheet registration device 43. In a less preferred but still operable alternative, the incoming sheets can be delivered to the top of such a stack 54 while outgoing sheets are removed from the bottom of that stack 54. This alternative is, however, more complex owing to the need to sense and mechanically operate on the interface of the bottom sheet of an outgoing stack, and the top sheet in an incoming stack.

Figure 2:
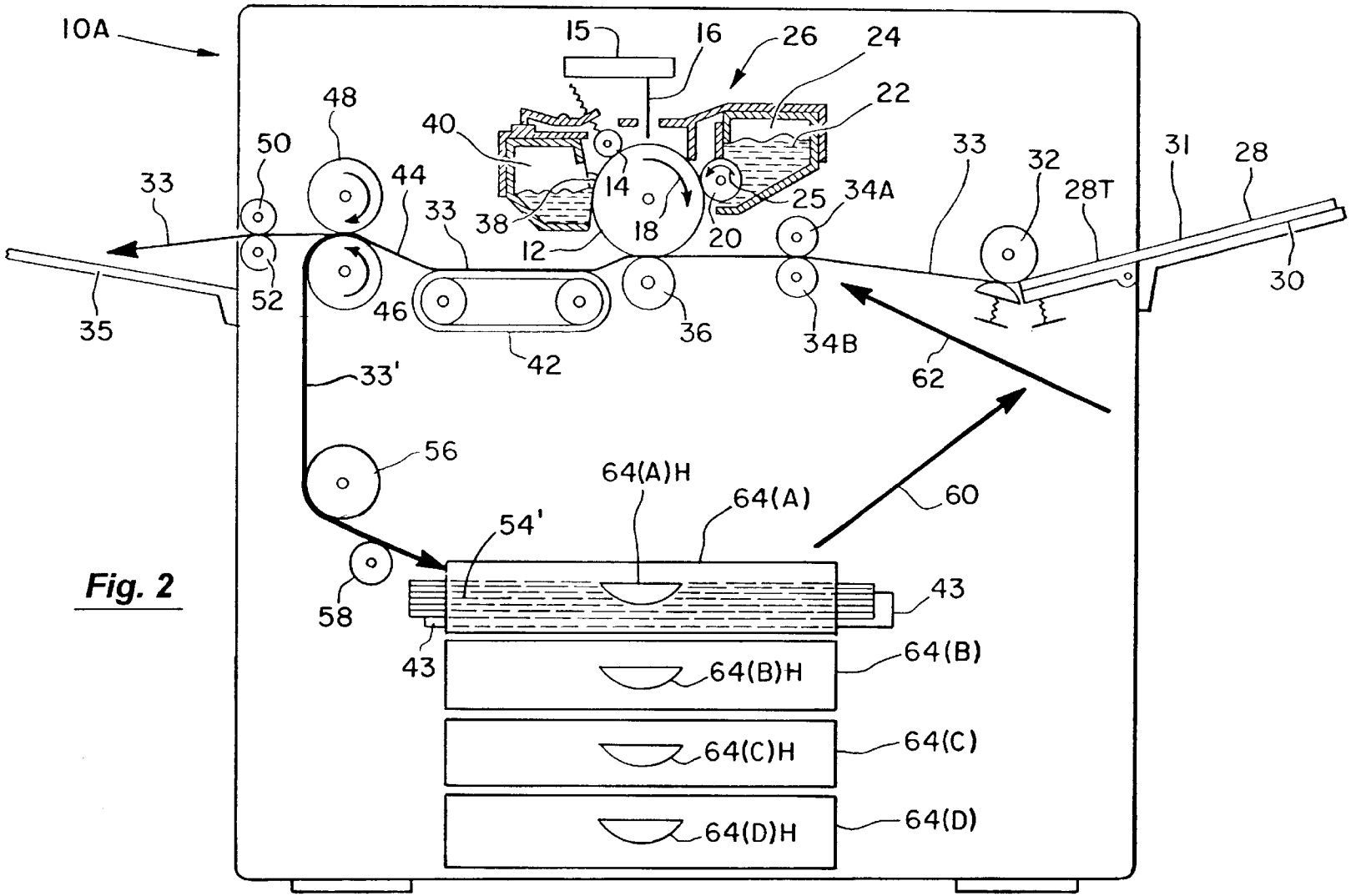
FIG. 2 is a cross sectional view of the electrophotographic printer of FIG. 1 provided with a sheet registration utilization device employed in accordance with the teachings of a first embodiment of this invention.

FIG. 2 shows an electrophotographic printer 10A that is similar to the prior art electrophotographic printer 10 shown in FIG. 1. The main difference is that the printer 10A of FIG. 2 is provided with a sheet registration utilization device 64(A). It is shown being employed according to the teachings of this patent disclosure. That is to say that the sheet registration utilization device 64(A) is positioned and deployed to take further advantage of the registration capability of a sheet registration device 43 that is primarily used to carry out a duplex printing operation. Consequently, the registration of the stack 54' shown in FIG. 2 can be thought of as a "second" registration action carried out by the registration device 43 shown in FIG. 1. The registration of a first stack (such as the stack 54 shown in FIG. 1) was carried out so that the sheets in the first stack 54 are in proper alignment to receive printing on their respective second (i.e., 12B) sides. The second registration of such a stack 54' (such as that shown in FIG. 2), is carried out in order to bind, or assist in binding, the stacked sheets together to create a book-like end product.

Thus, FIG. 2 further illustrates applicant's invention by showing that, after receiving printing on its second side, a given sheet 28 is again stacked with an array of other duplexed sheets in a second registered stack 54'. This second stack 54' of registered sheets is then subjected to a mechanical action carried out by a sheet registration utilization device 64(A). Such a device will normally be part of a module. Such a sheet registration utilization module 64(A) could be a stapler, a gluing device, a 3 hole punch system, a 2 hole punch system or any other device that operates upon a stack of sheets that must be in registration in order to be properly assembled, or prepared for assembly.

FIG. 2 depicts the printer 10A provided with (by way of example only) four different modules 64(A), 64(B), 64(C) and 64(D). These modules can be stored in the chassis of the printer 10A in the manner generally suggested in FIG. 2. FIG. 2 is also intended to suggest (by the presence of the respective module handles 64(A)H, 64(B)H, 64(C)H and 64(D)H) that these modules can be interchanged manually to accomplish different post second registration functions. Module 64(A) could be, for example, a 3 hole punch device such as that depicted in FIG. 3. Module 64(B) can be a gluing device such as that shown in FIG. 4, and so on. Thus, when the occasion demands, a given module e.g., 64(A) can be removed from its operating position and replaced by another module e.g., 64(B), 64(C), etc. Again, these module removal and replacement operations can be carried out manually—or by module handling devices not shown in FIG. 2.

Figure 3:
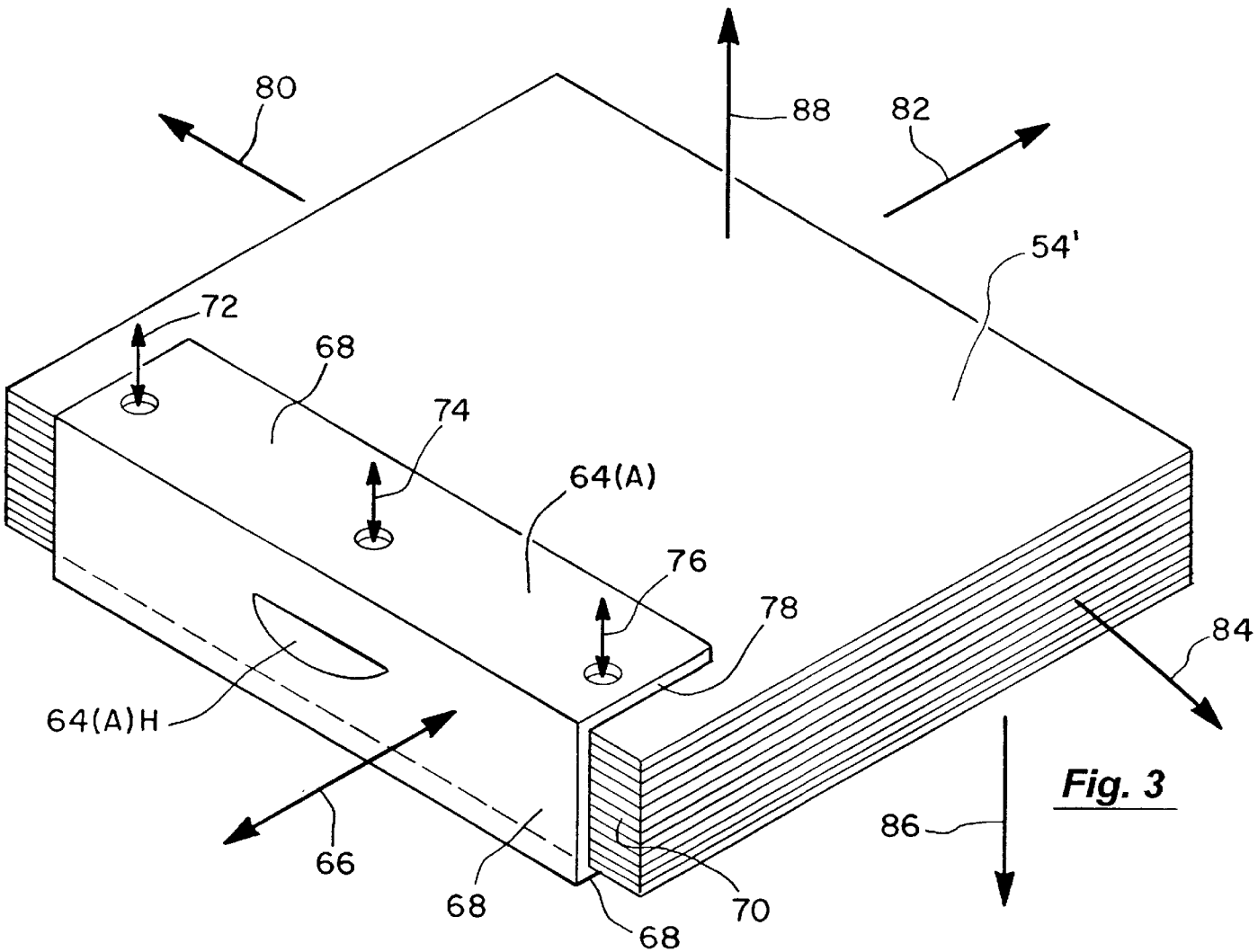
FIG. 3 is a perspective view of a stack of print media in registration and employing a "U"-shaped sheet registration utilization device having a 3-hole punch function.

FIG. 3 depicts a stack 54' of sheets (such as a stack of sheets of paper) that have been placed in registration by a registration device such as the registration device 43 generally depicted in FIGS. 1 and 2. Again, applicant's invention is particularly concerned with taking further advantage of the state of sheet registration depicted in FIG. 3. That is to say that once registered, the stack 54' is operated upon by a sheet registration utilization device such as those depicted in FIGS. 3–7 of this patent disclosure. Such a sheet registration utilization device could be, for example, a 3 hole punch module 64(A) such as that generally depicted in FIG. 3. Those skilled in these arts will appreciate that this module 64(A) is depicted in a highly generalized and highly simplified manner. Hence, such a module 64(A) also would normally include a mechanical means for moving said module 64(A) into and out of mechanical engagement with the registered stack 54'. The two-headed direction arrow 66 shown in FIG. 3 suggests that a channel-shaped element 68 of a 3 hole punch module 64(A) can be placed in and out of physical contact with a registered side 70 of a registered stack 54'. FIG. 3 also illustrates why sheet registration devices 43 that leave a registered side (e.g., side 70) of the stack 54' accessible (i.e., to a module 64(A), etc.) are preferred for the practice of this invention.

Here again, the handle 64(A)H shown on this 3 hole punch module 64(A) is meant to suggest that module 64(A) could be placed in operating position by a human being.

Again, such a human being could manually select from an array of modules such as those (64(A), 64(B), 64(C) and 64(D)) shown housed in the chassis of the printer 10A shown in FIG. 2. Once the module 64(A)—by whatever mechanical and/or manual means—has been properly positioned with respect to the registered stack 54', said 3 hole punch system is activated. In effect, three punch pins (not shown) are driven downward through the three holes 72, 74 and 76 depicted in the top channel arm 78 of the channel shaped element 68 of the module 64(A) and then through the registered stack 54'. The three punch pins are then withdrawn from the three holes created in the stack 54'. Thereafter the 3 hole punched stack 54' can be removed from the printer. This removal can generally take place in any of the general directions 66, 80, 82, 84, 86, 88, etc. suggested in FIG. 3.

Figure 4:
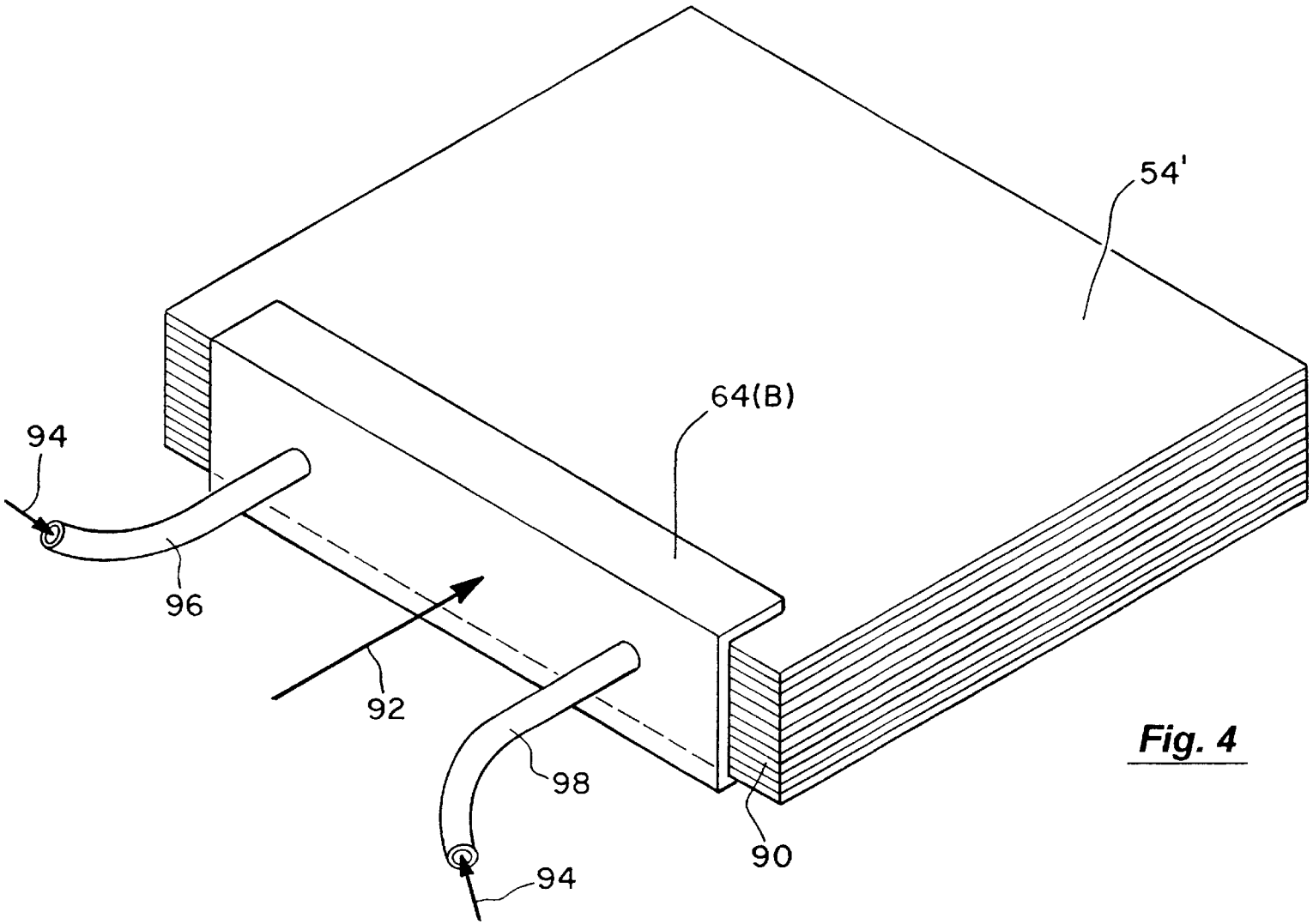
FIG. 4 is a perspective view of a stack of print media in registration and a "U"-shaped sheet registration utilization device having a gluing function.

FIG. 4 depicts another embodiment of this invention wherein a registered stack 54' is subjected to a different post registration process—namely a gluing operation that provides a registered edge 90 of the stack 54' with a glue binding system known to those skilled in the sheet binding arts. Such a binding module is driven (in the direction generally suggested by arrow 92) into engagement with a registered edge surface 90. Thereafter, a liquid or semi-liquid glue or binder material 94 is pumped into a cavity (not shown) in the module 64(B) via one or more injection conduits, e.g., injection conduits 96 and 98. The details of such gluing devices 64(B) are known to those skilled in this art and, hence, are omitted from FIG. 4 in order to illustrate the general concept of providing a glue type backing to an edge side 90 of a registered stack 54' in order to bind the individual sheets in that stack into a book-like body.

Figure 5:
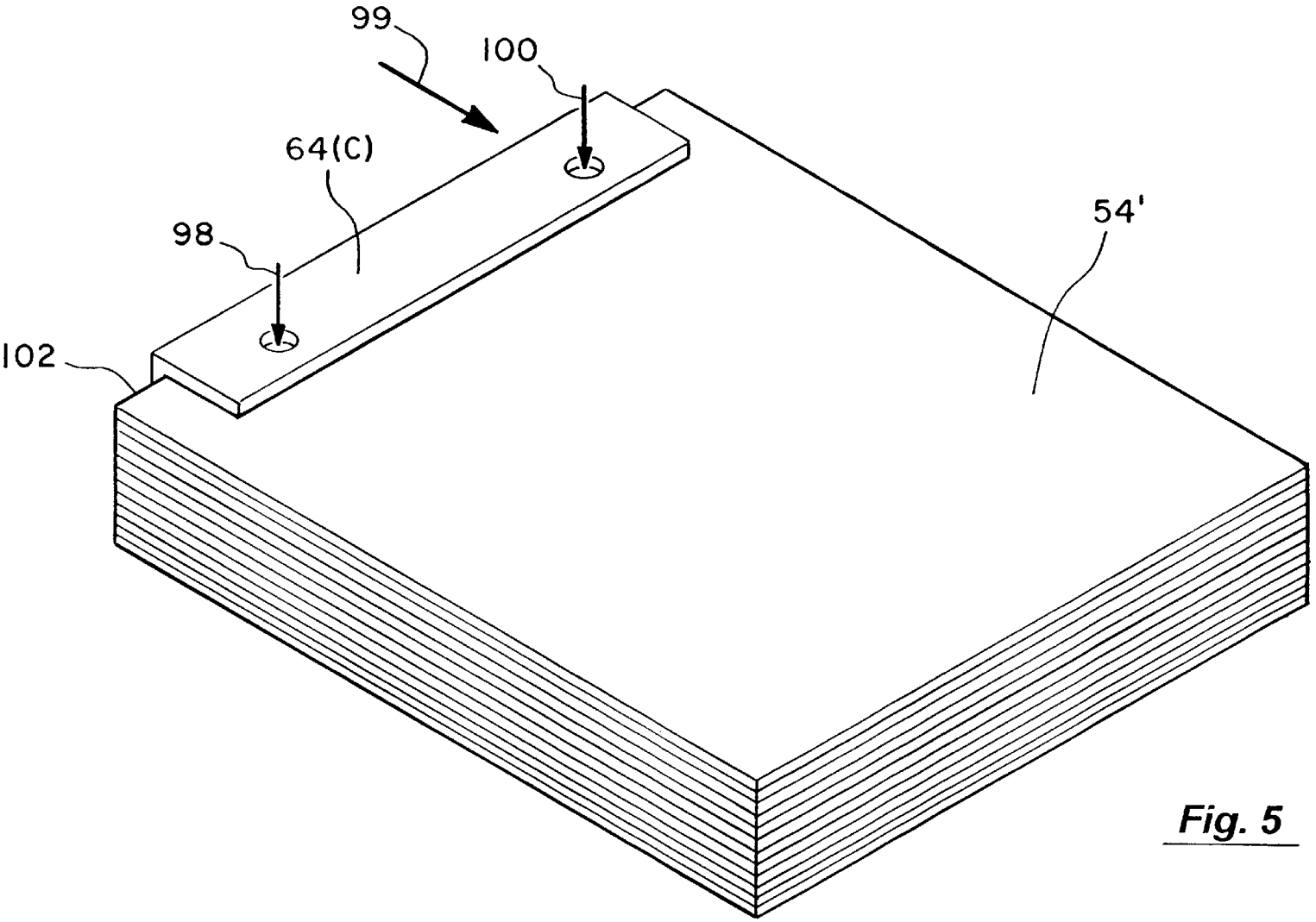
FIG. 5 is a perspective view of a stack of print media in registration and a "U"-shaped sheet registration utilization device having a 2-hole punch function.

FIG. 5 illustrates another embodiment of this invention wherein a sheet registration utilization module 64(C) carries out a 2 hole punch function on the top, width side of the stack 54'. To this end, sheet registration utilization module 64(C) is shown engaged with the top width side of the registered stack from the direction suggested by arrow 99. Thus, through the use of such a module 64(C), 2 holes (via openings 98 and 100 in the top of the 2 hole punch module) can be punched in such a top, width side 102 of such a registered stack 54'.

Figure 6:
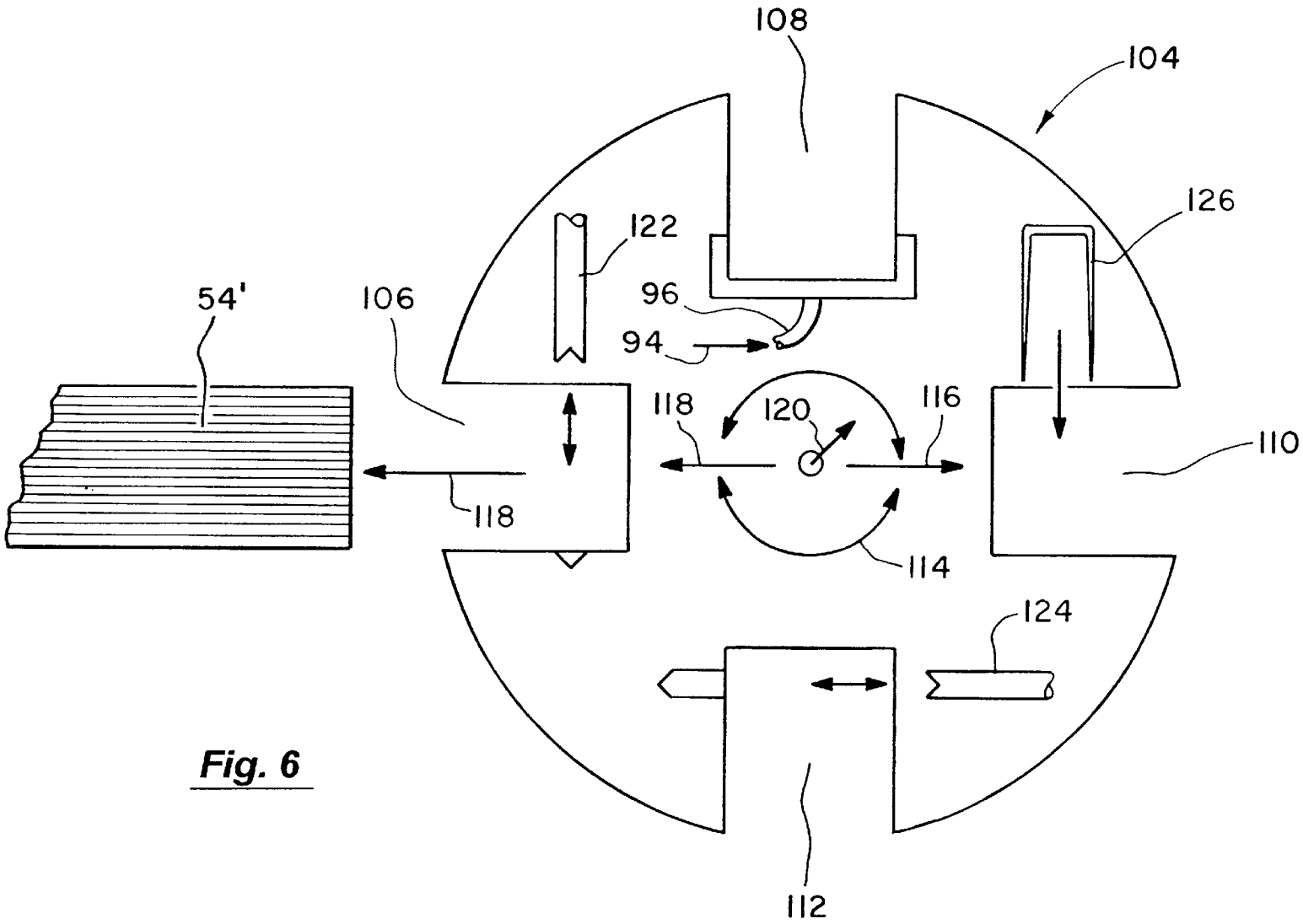
FIG. 6 is a cut-away side view of a multi-functional sheet registration utilization device before one of its sheet assembly functions is associated with a stack of registered sheets.

FIG. 6 depicts a multi-purpose sheet registration utilization device 104. This multi-purpose sheet registration utilization device 104 will preferably permanently reside in the printer 10's housing. This particular multi-purpose sheet registration utilization device 104 is shown provided (by way of example only) with four work stations 106, 108, 100 and 112. Direction arrows 114, 116, 118 and 120 are intended to suggest that such a multi-purpose sheet registration device 104 can be mechanically driven in any direction in order to position a given work station with respect to a length side, or a width side, of a given registered stack 54'. By way of example only, FIG. 6 depicts work station 106 provided with a highly generalized punch hole device 122. FIG. 6 also suggests that work station 106 of the sheet registration utilization device 104 is moving in a leftward direction 118 that will cause it to engage with the registered stack 54'. FIG. 6 also shows the multi-purpose sheet registration utilization device 104 provided with a work station 108 adapted and arranged to carry out a gluing function such as that shown in FIG. 4. Another work station 110 is shown in association with a powered stapler device that is generally symbolized by staple 126. Work station 112 is shown provided with another hole punching device 124 (e.g., a 2 hole punch device) that is different from the 3 hole punch system provided in work station 106.

Figure 7:
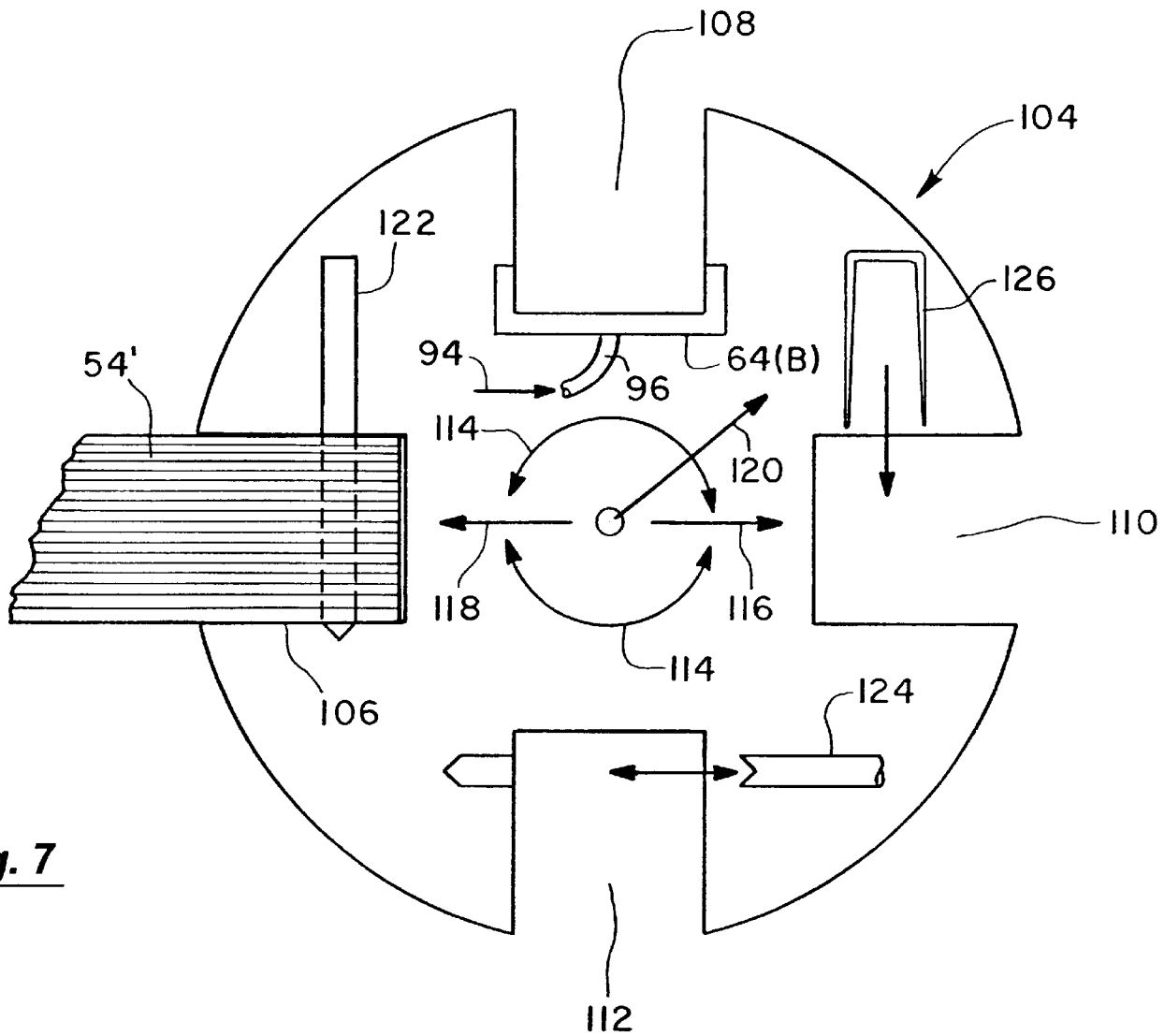
FIG. 7 is a cut-away side view of a multi-functional sheet registration utilization device having one of its sheet assembly functions (hole punching) being carried out with respect to a stack of registered sheets.

FIG. 7 depicts a registered stack 54' completely engaged with work station 106. By way of example only, this work station 106 could be a 3 hole punch system such as that depicted in FIG. 3. Such a multi-purpose sheet registration apparatus 104 could be provided with other sheet binding devices known to the sheet binding arts. The sheet assembly devices shown in FIGS. 6 and 7 (and especially the stapling and 3 hole punch devices) are especially preferred for such a multi-purpose sheet registration device 104.

Although specific embodiments of this invention have been disclosed herein in detail, it is to be understood that this was for purposes of illustration only. For example, the electrophotographic printer used to illustrate this invention could be replaced (e.g., with an inkjet printer) by those skilled in the art in order to adapt applicant's sheet registration utilization devices to other applications without departing from the scope of the following claims, and equivalents of the claimed elements of said claims.

I claim:

1. A duplex printing device comprising:

(1) a printer;

(2) a media path system;

(3) a sheet registration device that (i) places a stack of sheets in registration for a first time in order to carry out a duplex printing operation on said sheets and (ii) places a stack of said sheets in registration for a second time so that said sheets in registration for the second time can be subjected to an operation carried out by a sheet registration utilization device; and (4) a sheet registration utilization device that contains multiple work stations and which can be rotated about an axis in order to select a given work station and then be moved laterally to engage said given work station with the stack of sheets in registration for the second time.

2. The duplex printing device of claim 1 wherein the printer is an electrophotographic printer.

3. The duplex printing device of claim 1 wherein the printer is an inkjet printer.

4. The duplex printing device of claim 1 wherein the sheet registration utilization device is a 3 hole punch.

5. The duplex printing device of claim 1 wherein the sheet registration utilization device is a stapler.

6. The duplex printing device of claim 1 wherein the sheet registration utilization device is a gluing device.

7. The duplex printing device of claim 1 wherein the sheet registration utilization device is a 2 hole punch.

8. The duplex printing device of claim 1 wherein the stack of sheets in registration for the second time is a stack of sheets of paper.

9. The duplex printing device of claim 1 wherein the sheet registration utilization device is a plurality of distinct modules for performing distinct mechanical operations on the stack of sheets in registration for the second time.

10. The duplex printing device of claim 1 wherein the sheet registration utilization device is a plurality of distinct modules that comprise a stapling module and a 3 hole punch module.

11. The duplex printing device of claim 1 wherein the sheet registration utilization device is a single, multipurpose device having a plurality of work stations.

12. The duplex printing device of claim 1 wherein the sheet registration utilization device is a single, multipurpose device having a plurality of work stations that comprise a stapler work station and a 3 hole punch work station.

13. An electrophotographic, duplex printing device comprising:

(1) a laser printing device;

(2) a media path system;

(3) a sheet registration device that (i) places a stack of sheets in registration for a first time in order to carry out a duplex printing operation on said sheets and (ii) places a stack of said sheets in registration for a second time so that said sheets in registration for the second time can be subjected to an operation carried out by a sheet registration utilization device; and (4) a sheet registration utilization device that contains multiple work stations and which can be rotated about an axis in order to select a given work station and then be moved laterally to engage said given work station with the stack of sheets in registration for the second time.

14. The duplex printing device of claim 13 wherein said device is a desktop, electrophotographic printer.

15. The duplex printing device of claim 13 wherein said device is an inkjet printer.

16. The duplex printing device of claim 13 wherein the sheet registration utilization device is a 3 hole punch.

17. The duplex printing device of claim 13 wherein the sheet registration utilization device is a stapler.

18. The duplex printing device of claim 13 wherein the sheet registration utilization device is a gluing device.

19. The duplex printing device of claim 13 wherein the sheet registration utilization device is a 2 hole punch.

20. An electrophotographic, duplex printing device comprising:

(1) a laser printing device for creating a latent image on a photoconductor drum;

(2) a photoconductor drum whose outside surface defines a upper side of a toner transfer zone;

(3) a transfer roller whose outside surface defines a lower side of the toner transfer zone;

(4) a first media path that leads through the printing device without passing through a sheet registration device;

(5) a second media path that leads to the sheet registration device;

(6) a third media path that leads from the registration device back to the toner transfer zone;

(7) a sheet registration device that (i) places a stack of sheets in registration for a first time in order to carry out a duplex printing operation on said sheets and (ii) places a stack of said sheets in registration for a second time so that said sheets in registration for the second time can be subjected to an operation carried out by a sheet registration utilization device; and (8) a sheet registration utilization device that contains multiple work stations and which can be rotated about an axis in order to select a given work station and then be moved laterally to engage said given work station with the stack of sheets in registration for the second time.

* * * * *